US009703232B2

(12) United States Patent
Shinkawa et al.

(10) Patent No.: US 9,703,232 B2
(45) Date of Patent: Jul. 11, 2017

(54) IMAGE FORMING APPARATUS THAT PERFORMS A CONTACTING OPERATION FOR CONTACTING A DEVELOPING MEMBER WITH AN IMAGE BEARING MEMBER

(71) Applicant: CANON KABUSHIKI KAISHA, Tokyo (JP)

(72) Inventors: Takaaki Shinkawa, Yokohama (JP); Yuji Kawaguchi, Tokyo (JP); Takahiro Ikeda, Oyama (JP); Jun Miura, Kawasaki (JP); Shunsuke Mizukoshi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/019,192

(22) Filed: Feb. 9, 2016

(65) Prior Publication Data

US 2016/0231665 A1 Aug. 11, 2016

(30) Foreign Application Priority Data

Feb. 10, 2015 (JP) ..... 2015-024792
Jan. 14, 2016 (JP) ..... 2016-005569

(51) Int. Cl.

*G03G 15/00* (2006.01)
*G03G 15/06* (2006.01)
*G03G 15/08* (2006.01)
*G03G 21/00* (2006.01)

(52) U.S. Cl.

CPC ..... *G03G 15/065* (2013.01); *G03G 15/0822* (2013.01); *G03G 21/0011* (2013.01); *G03G 21/0094* (2013.01)

(58) Field of Classification Search

CPC .. G03G 15/06; G03G 15/065; G03G 15/0121; G03G 21/0094; G03G 2215/018; G03G 15/0822; G03G 21/0011
USPC ..... 399/53, 228
See application file for complete search history.

(56) References Cited

U.S. PATENT DOCUMENTS

2014/0314431 A1* 10/2014 Morihara ..... G03G 15/0136 399/228 X

FOREIGN PATENT DOCUMENTS

JP 4278968 A 10/1992
JP 4194275 B2 12/2008

* cited by examiner

*Primary Examiner* — Sophia S Chen
(74) *Attorney, Agent, or Firm* — Rossi, Kimms & McDowell LLP

(57) ABSTRACT

An image forming apparatus includes image forming portions each including an image bearing member, a charging portion, an exposure portion, a developing portion including a developing member, and a cleaning member; a contact-and-separation portion; a voltage source; and a control means. An operation is executed in a contact state of the developing member with the image bearing member at the image forming portion where the image is formed, in a separated state of the developing member from the image bearing member at the image forming portion where the image is not formed and in a state in which the image bearing members of the image forming portions where the image is formed and is not formed are driven. When the operation is continuously executed, the control means executes a contacting operation at the image forming portion where the image is not formed.

19 Claims, 7 Drawing Sheets

IMAGE FORMING APPARATUS THAT PERFORMS A CONTACTING OPERATION FOR CONTACTING A DEVELOPING MEMBER WITH AN IMAGE BEARING MEMBER

FIELD OF THE INVENTION AND RELATED ART

The present invention relates to an image forming apparatus, such as a copying machine, a printer or a facsimile machine, using an electrophotographic process or an electrostatic recording process.

Conventionally, for example, as an image forming apparatus, such as the copying machine, the printer or the facsimile machine, using the electrophotographic process, a tandem type image forming apparatus independently including image forming portions for forming images with toners of colors of yellow, magenta, cyan and black is used. As a developing type of a latent image formed on an image bearing member at each of the image forming portions, a contact developing type in which development is effected in a contact state between the image bearing member and a developing member is used.

In the tandem type image forming apparatus, in some cases, an operation in a mode in which an image is formed only at a part of a plurality of image forming portions is performed. Japanese Laid-Open Patent Application (JP-A) Hei 4-278968 discloses a method in which two species of operations in (different) modes consisting of an operation in a full-color mode in which toners of image formation is effected using all of the colors of yellow, magenta, cyan and black and an operation in a monochromatic mode in which a monochromatic image (block (single color) image) is formed using only a black toner.

In the case where the image is formed only at a specific image forming portion, such a method that a deterioration of an image bearing member, a developing member or a toner is suppressed by spacing (separating) the developing member from the image bearing member at image forming portions where the image is not formed has been known.

Further, for the purpose of cost reduction of an apparatus main assembly of the image forming apparatus, a constitution in which a plurality of image bearing members are driven by a common driving source in some cases.

However, in the case where the image is formed only at the specific image forming portion, in the constitution the developing member is spaced from the image bearing member at the image forming portions where the image is not formed, the following problem arises.

That is, conventionally, in order to remove a developer remaining on the image bearing member after a toner image formed on the image bearing member is transferred onto a transfer-receiving member, a cleaning blade is contacted in general as a cleaning member to the image bearing member. Usually, between the cleaning blade and the image bearing member, the toner and an external additive thereof exist and function as a lubricant, so that a frictional force between the image bearing member and the cleaning blade is properly reduced and thus a good cleaning performance is maintained.

However, in the case where the image is formed only at the specific image forming apparatus, when the developing member is spaced from the image bearing member at the (remaining) image forming portions where the image is not formed, the toner and the external additive which function as the lubricant are not supplied to between the cleaning blade and the image bearing member. Further, in the case where the image bearing members are rotated also at the image forming portions where the image is not formed, such as in the case where a plurality of image bearing members are rotationally driven in interrelation with each other. As a result, the frictional force at a contact portion between the cleaning blade and the image bearing member gradually increases, so that the case where vibration of the cleaning blade and the image bearing member increases and (unusual) noise (cleaning blade noise) generates occurs in some cases.

In JP-A Hei 4-278968, in a constitution in which the image bearing members and the developing members contact each other at all of the image forming portions also during the operation in the monochromatic mode, supply of the developer to contact portions of the cleaning blades with the image bearing members has been proposed. However, in such a constitution, at the image forming portions where the image is not formed in the operation in the monochromatic mode, the deterioration of the image bearing members, the developing members or the toner has progressed.

SUMMARY OF THE INVENTION

A principal object of the present invention is to provide an image forming apparatus capable of suppressing not only a direction of image bearing members, developing members or developers but also generation of noise due to cleaning members, at image forming portions where images are not formed in the case where an image is formed only at a specific image forming portion.

According to an aspect of the present invention, there is provided an image forming apparatus comprising: a plurality of image forming portions each including an image bearing member to be rotationally driven, charging means for electrically charging the image bearing member, exposure means for exposing the charged image bearing member to light to form a latent image including an exposed portion as an image portion, developing means, including a developing member movable toward and away from the image bearing member, for forming an image with a developer on the image bearing member by contacting the developing member with the image bearing member, and a cleaning member for removing the developer from the image bearing member in contact with the image bearing member; contact-and-separation means for moving the developing member toward and away from an associated one of the image bearing members of the image forming portions; a voltage source for applying, to the developing member, a developing voltage for urging the developer toward the image portion of the latent image on the image bearing member; and control means for executing a contacting operation for contacting the developing member to which the developing voltage is applied with the image bearing member charged by the charging means for a predetermined period, wherein the image forming apparatus is capable of executing an operation in a mode in which the image is formed only at a part of the image forming portions, and the operation in the mode is executed in a state in which the developing member is contacted to the image bearing member at the image forming portion where the image is formed and the developing member is separated from the image bearing member at the image forming portion where the image is not formed and in which the image bearing members of the image forming portion where the image is formed and the image forming portion where the image is not formed are driven, and wherein when the operation in the mode is continuously executed, the control means executes the contacting operation at the image forming portion where the image is not formed.

Further features of the present invention will become apparent from the following description of exemplary embodiments with reference to the attached drawings.

DESCRIPTION OF THE EMBODIMENTS

An image forming apparatus according to the present invention will be described in detail with reference to the drawings.

Embodiment 1

1. General Structure and Operation of Image Forming Apparatus

Figure 1:
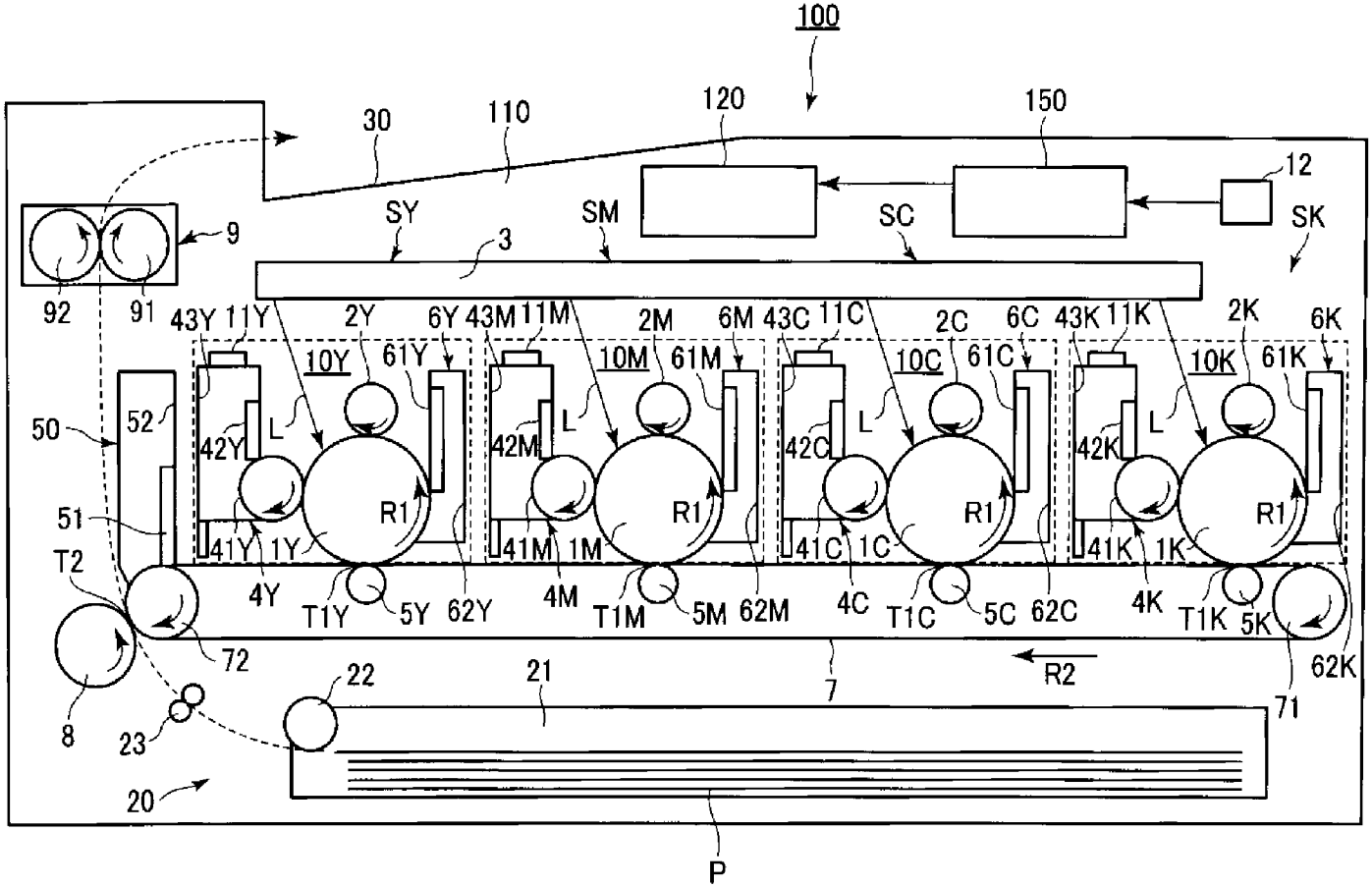
FIG. 1 is a schematic sectional view of an image forming apparatus.

FIG. 1 is a schematic sectional view of an image forming apparatus 100 according to an embodiment of the present invention. In this embodiment, the image forming apparatus 100 is a tandem type color laser printer employing an intermediary transfer type in which first to fourth image forming portions (stations) SY, SM, SC, SK are provided. Image formation at the image forming portions SY, SM, SC, SK is effected using an electrophotographic process. At the image forming portions SY, SM, SC, SK, images of colors of yellow (Y), magenta (M), cyan (C), black (K) are formed, respectively.

Incidentally, with respect to elements which are provided at the image forming portions SY, SM, SC, SK and which have the same functions and structures, in the case where the elements are not required to be particularly distinguished, suffixes Y, M, C, K of reference numerals or symbols showing the elements for any of the image forming portions are omitted, and the elements will be collectively described.

In an apparatus main assembly 110 of the image forming apparatus 100, a controller 150 as a control means for controlling an operation of the image forming apparatus 100 is provided. To the controller 150, image data (electrical image information) is inputted from an external host device (not shown). The image forming apparatus 100 forms an image corresponding to the image data inputted into the controller 150 on a recording material P such as a recording sheet, and outputs an image-formed product.

The image forming apparatus 100 includes a photosensitive drum 1 which is a drum-shaped (cylindrical) electrophotographic photosensitive member as an image bearing member. At a periphery of the photosensitive drum 1, the following devices are provided. First, a charging roller 2 which is a roller type charging member as a charging means is disposed. Further, a developing device 4 as a developing means is disposed. Further, a drum cleaner 6 as a cleaning means is disposed.

The photosensitive drum 1 is rotationally driven in an arrow R1 direction in FIG. 1 at a predetermined peripheral speed (surface moving speed) by a drum driving motor (driving source) 120 as a photosensitive member driving means. In this embodiment, all of the photosensitive drums 1Y, 1M, 1C, 1K of the first to fourth image forming portions SY, SM, SC, SK are rotationally driven by a common drum driving motor 120. That is, in this embodiment, a single drum driving motor 120 is driven and stopped by receiving signals from the controller 150, and depending on the drive and stop of this single driving motor 120, all of the photosensitive drums 1Y, 1M, 1C, 1K are driven and stopped. As a result, compared with constitution in which the plurality of photosensitive drums are rotationally driven by separate driving means, respectively, a constitution of the image forming apparatus 100 can be simplified and reduced in cost.

The developing device 4 uses a non-magnetic one-component developer (toner) as a developer. In this embodiment, the toner is negatively chargeable. The developing device 4 includes a developing roller 41 as a developing member (developer carrying member) for carrying and feeding the toner, a developing blade 42 for uniformizing a toner layer on the developing roller 41, and a developing container 43. In the developing containers 43Y, 43M, 43C, 43K of the developing devices 4Y, 4M, 4C, 4K, the toners of the colors of yellow (Y), magenta (M), cyan (C), black (K) are accommodated, respectively. The developing device 4 is an example of a developing means, including the developing member capable of moving toward and away from the image bearing member, for forming the image with the developer in contact with the image bearing member. In this embodiment, the developing rollers 41Y, 41M, 41C, 41K of the developing devices 4Y, 4M, 4C, 4K are independently rotationally driven by an unshown developing (roller) driving motor as a developing (roller) driving means.

In this embodiment, at each of the image forming portions S, the photosensitive drum 1, and as process means actable on the photosensitive drum 1, the charging roller 2, the developing device 4 and the drum cleaner 6 integrally constitute a process cartridge 10 detachably mountable to the apparatus main assembly. In this embodiment, each of the process cartridges 10 is provided with a memory 11 as a storing means. The apparatus main assembly 110 is provided with a reading and writing means (not shown) for reading and writing information stored in the memory 11. The controller 150 is capable of writing and reading various pieces of information on the process cartridge obtained by computation in and from the memory 11. Then, on the basis of the information stored in the memory 11, the controller effects various pieces of control of the image forming apparatus 100.

The image forming apparatus 100 further includes an exposure device (laser exposure unit), as a latent image forming means (exposure means) for forming a latent image on the photosensitive drum 1 at each of the image forming portions S, for exposing each of the photosensitive drums 1 to light.

The image forming apparatus 100 further includes an intermediary transfer belt 7, as an intermediary transfer member, which is provided opposed to the photosensitive drums 1 and which is formed with an endless belt. The intermediary transfer belt 7 is stretched by two stretching rollers, as a plurality of supporting members, consisting of a driving roller 71 and a secondary transfer opposite roller 72. The driving roller 71 is rotationally driven by an unshown belt driving motor as an intermediary transfer member driving means, whereby the intermediary transfer belt 7 is rotationally driven (circulated) in an arrow R2 direction in FIG. 1. In an inner peripheral surface side of the intermediary transfer belt 7, at positions opposing the photosensitive drums 1 through the intermediary transfer belt 7, primary transfer rollers 5 which are roller-shaped primary transfer members as primary transfer means are provided. The primary transfer 5 contacts the intermediary transfer belt 7 toward the photosensitive drum 1 at a predetermined pressure (urging force) and forms a primary transfer portion (primary transfer position, primary transfer nip) T1 where the intermediary transfer belt 7 and the photosensitive drum 1 contact each other. On another peripheral surface side, at a position opposing the secondary transfer opposite roller 72 through the intermediary transfer belt 7, a secondary transfer roller 8 which is a roller-shaped secondary transfer member as a secondary transfer means is provided. The secondary transfer roller 8 contacts the intermediary transfer belt 7 toward the secondary transfer opposite roller 72 at a predetermined pressure and forms a secondary transfer portion (secondary transfer position, secondary transfer nip) T2. On the outer peripheral surface side, at a position downstream of the secondary transfer portion T2 and upstream of an upstreammost primary transfer portion T1Y with respect to a movement direction of the intermediary transfer belt 7, a belt cleaner 50 as an intermediary transfer member cleaning means is provided.

The image forming apparatus 100 further includes a fixing unit 9, a feeding unit 20 and the like. The fixing unit 9 includes a fixing roller 91 heated by a fixing heater and a pressing roller 92 pressed against the fixing roller 91 at a predetermined pressure. The feeding unit includes a cassette for accommodating a recording material (transfer material, recording medium) P, a pick-up roller 22 for sending the recording material P one by one from the cassette 21, a feeding roller pair 23 for feeding the recording material P sent from the pick-up roller 22, and the like member.

In this embodiment, each of the image forming portions S is constituted by the photosensitive drum 1, the charging roller 2, the exposure device 3 for exposing the photosensitive drums 1 to light L, the developing device 4, the primary transfer roller 5, and the like member.

2. Image Forming Process

When the controller 150 receives a print signal (image formation start signal, the image forming apparatus 100 starts an operation of a rotationally driving portion such as the photosensitive drum 1 and the intermediary transfer belt 7, and thus starts an image forming operation. After rotation of the photosensitive drum 1 is started, a predetermined charging voltage (charging bias) is applied from an unshown charging voltage source (high voltage source) to the charging roller 2, so that the surface of the photosensitive drum 1 is electrically charged uniformly to a predetermined potential. The charged surface of the photosensitive drum 1 is exposed to light L depending on image information by the exposure device 3, so that a latent image (electrostatic latent image, electrostatic image) is formed on the photosensitive drum 1.

The latent image formed on the photosensitive drum 1 is developed (visualized) into a toner image (developer image) with the toner on the developing roller 41, of the developing device 4, rotating in contact with the photosensitive drum 1. At this time, to the developing roller 41, a predetermined developing voltage (developing bias) is applied from an unshown developing voltage source (high voltage source). In this embodiment, the developing device 4 forms the toner image by reversal development. That is, on an exposed portion of the photosensitive drum 1 where an absolute value of the potential is lowered by the exposure after the photosensitive drum 1 is uniformly charged, the toner charged to the same polarity (negative in this embodiment) as a charge polarity of the photosensitive drum 1 is deposited. The developing voltage source is a voltage source for applying the developing voltage for urging the developer from the developing member toward an image portion (exposed portion) of the latent image on the image bearing member.

The toner image formed on the photosensitive drum 1 is transferred (primary-transferred) onto the intermediary transfer belt 7 at the primary transfer portion T1 by the action of the primary transfer roller 5. At this time, to the primary transfer roller 5, a primary transfer voltage (primary transfer bias) which is a DC voltage of an opposite polarity (positive in this embodiment) to a charge polarity of the toner during the development is applied from an unshown primary transfer voltage source (high voltage source). For example, during full-color image formation for example, the above-described steps of the charging, the exposure, the development and the primary transfer are successively performed. As a result, a multiple toner image transferred onto the intermediary transfer belt 7 so as to superposed the toner images of the respective colors.

The toner images formed on the intermediary transfer belt 7 are transferred (secondary-transferred) onto the recording material P at the secondary transfer portion T2 by the action of the secondary transfer roller 8. At this time, to the secondary transfer roller 8, a secondary transfer voltage (secondary transfer bias) which is a DC voltages of the opposite polarity to the normal charge polarity of the toner is applied from an unshown secondary transfer voltage source (high voltage source). The recording material P is fed to the secondary transfer portion T2 at predetermined timing by the feeding unit 20.

The recording material P on which the toner images are transferred passes through between the fixing roller 91 warmed to a predetermined temperature and the pressing roller 92 pressed against the fixing roller 91 at a predetermined pressure in the fixing unit 9. As a result, the toner is melted and fixed on the recording material P, and thereafter the recording material P is fed to a discharge tray 30 at an outer portion of the apparatus main assembly 110.

In parallel to the above step, a step of removing transfer residual toners on the photosensitive drum 1 and the intermediary transfer belt 7 is performed. That is, the toner (primary transfer residual toner) remaining on the photosensitive drum 1 without being transferred onto the intermediary transfer belt 7 at the primary transfer portion T1 is removed and collected from the photosensitive drum 1 by the drum cleaner 6. The drum cleaner 6 scrapes off the primary transfer residual toner from the rotating photosensitive drum 1 and collects the primary transfer residual toner in a cleaner container 62 by the cleaning blade 61 as the cleaning member disposed in contact with the photosensitive drum 1. Further, the toner (secondary transfer residual toner) remaining on the intermediary transfer belt 7 without being transferred onto the recording material P at the secondary transfer portion T2 is removed and collected by the belt cleaner 50. The belt cleaner 50 scraped off the secondary transfer residual toner from the rotating intermediary transfer belt 7 and collects the secondary transfer residual toner in a cleaner container 52 by the cleaning blade 51 as the cleaning member disposed in contact with the intermediary transfer belt 7.

3. Contact-and-Separation Means

Figure 2A:
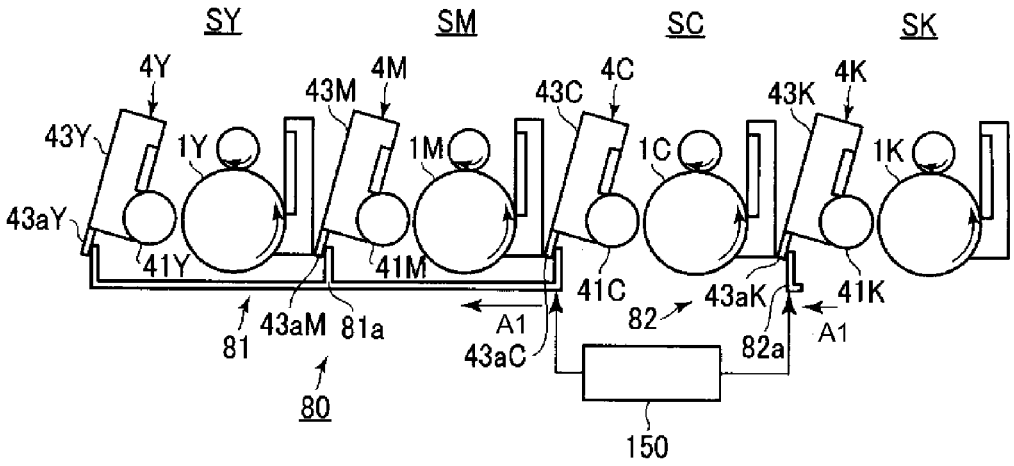
FIGS. 2*a* and 2*b* are schematic views for illustrating an operation of a contact-and-separation mechanism.
Figure 2B:
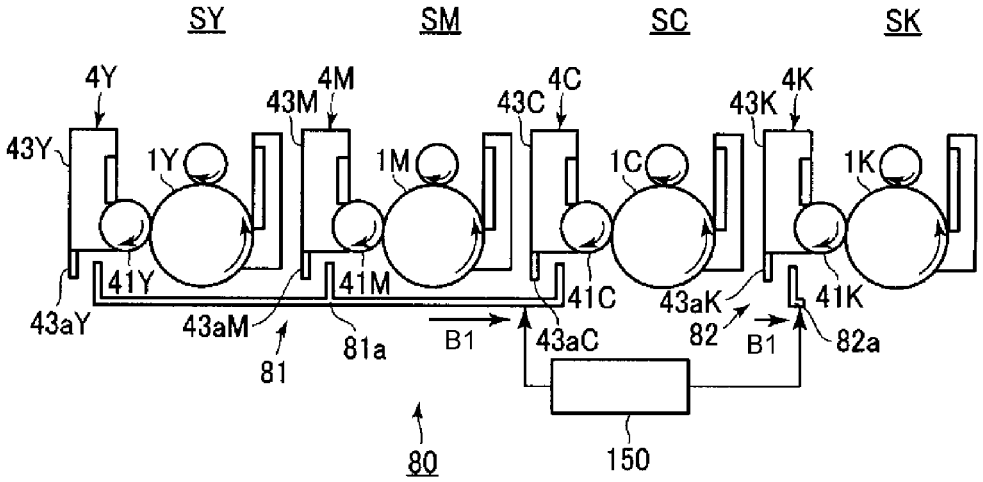

FIGS. 2*a* and 2*b* are schematic views for illustrating a contact-and-separation means 80 for moving the developing roller 41 of the developing device 4 toward and away from the photosensitive drum 1 in this embodiment. In this embodiment, the contact-and-separation means 80 includes a first contact-and-separation mechanism 81 for moving the developing rollers 41Y, 41M, 41C toward and away from the corresponding photosensitive drums 1Y, 1M, 1C of the first to third image forming portions SY, SM, SC, respectively. Further, in this embodiment, the contact-and-separation means 80 includes a second contact-and-separation mechanism 82 for moving the developing roller 41K toward and away from the corresponding photosensitive drum 1K of the fourth image forming portion SK. In this embodiment, the first contact-and-separation mechanism 81 places the developing rollers 41Y, 41M, 41C corresponding to the photosensitive drums 1Y, 1M, 1C of the first to third image forming portions SY, SM, SC simultaneously in a contact state or a spaced state.

Incidentally, herein, the image forming portions SY, SM, SC, SK or elements for the image forming portions SY, SM, SC, SK are distinguished by adding prefixes "Y", "M", "C", "K" in some cases. A state in which the developing roller 41 is contacted to or spaced (separated) from the associated photosensitive drum 1 by the first or second contact-and-separation mechanism 81 or 82 is also referred to simply as the "contact state" or the "spaced state" of the first or second contact-and-separation mechanism 81 or 82 or the developing roller 41.

FIG. 2*a* shows the spaced state of the first and second contact-and-separation mechanisms 81 and 82. The first and second contact-and-separation mechanisms 81 and 82 more moving members 81*a* and 82*a*, respectively, in an arrow A1 direction in the figure by an operation of an unshown contact-and-separation (mechanism) driving motor as a contact-and-separation driving means upon receipt of a signal from the controller 150. As a result, the first and second contact-and-separation mechanisms 81 and 82 push receiving portions 43*a* formed as a part of the developing containers 43 by the moving members 81*a* and 82*a*, so that the developing rollers 41 are placed in the spaced state. In this embodiment, as described above, the developing rollers 41 of the developing devices 4Y, 4M, 4C, 4K are rotationally driven by independent developing driving motors. In this embodiment, when the developing rollers are placed in the spaced state, the corresponding developing driving motors are controlled by the controller 150, so that the rotational drive of the developing rollers 41 is stopped.

FIG. 2*b* shows the contact state of the first and second contact-and-separation mechanisms 81 and 82. The first and second contact-and-separation mechanisms 81 and 82 more the moving members 81*a* and 82*a*, respectively, in an arrow B1 direction in the figure by the operation of the unshown contact-and-separation (mechanism) driving motor upon receipt of a signal from the controller 150. As a result, the first and second contact-and-separation mechanisms 81 and 82 eliminate the urging of the receiving portions 43*a* of the developing containers 43, so that the developing rollers 41 are placed in the contact state. In this embodiment, the developing containers 43 are swingably held, and the developing rollers 41 are urged in a contact direction with the photosensitive drums 1 by springs as an urging means. In this embodiment, when the developing rollers are placed in the contact state, the corresponding developing driving motors are controlled by the controller 150, so that the rotational drive of the developing rollers 41 is started.

In this embodiment, the image forming apparatus 100 is capable of executing an operation in a full-color mode in which images are formed at all of the YMCK image forming portions SY, SM, SC, SK and an operation in a monochromatic mode in which an image is formed only at the K image forming portion SK. The controller 150 controls the first and second contact-and-separation mechanisms 81 and 82 so as to be placed in the contact state during the operation in the full-color mode. During the operation in the full-color mode, all of the photosensitive drums 1Y, 1M, 1C, 1K and all of the developing rollers 41Y, 41M, 41C, 41K are rotationally driven. During the operation in the monochromatic mode, the controller 150 controls the first contact-and-separation mechanism 81 so as to be placed in the spaced state and controls the second contact-and-separation mechanism 82 so as to be placed in the contact state. During the operation in the monochromatic mode, all of the photosensitive drums 1Y, 1M, 1C, 1K are rotationally driven, but the rotational drive of the YMC developing rollers 41Y, 41M, 41C is stopped. Further, during the operation in the monochromatic mode, at the YMC image forming portions SY, SM, SC, the charging voltage and the developing voltage are not applied.

4. Developing Roller Contacting Operation in Monochromatic Mode

In this embodiment, control for moving the developing rollers 41 toward and away from the photosensitive drum 1 at the YMC image forming portions SY, SM, SC is effected during the operation in the monochromatic mode will be described.

In this embodiment, when the operation in the monochromatic mode is continuously executed, at the YMC image forming portions SY, SM, SC, a contacting operation for contacting the developing rollers 41 with the photosensitive drums 1 for a predetermined period is executed. Particularly, in this embodiment, the contacting operation is executed on the basis of information on a used amount of the photosensitive drums 1 of the YMC image forming portions SY, SM, SC. Specifically, in the operation in the monochromatic mode, in the case where the used amount of the photosensitive drums 1 of the YMC image forming portions SY, SM, SC in the spaced state of the developing rollers 41 exceeds a predetermined threshold (first threshold), the developing rollers 41 are contacted to the photosensitive drums 1. More specifically, in the contacting operation, in the case where the used amount of the photosensitive drum 1 exceeds a predetermined threshold (second threshold) after the developing roller 41 is contacted to the photosensitive drum 1, the developing roller 41 is spaced from the photosensitive drum 1. As a result, typically, when the operation in the monochromatic mode is continuously executed, the above-described contacting operation is periodically repeated. As a result, even when the operation in the monochromatic mode is continuously executed, at the YMC image forming portions SY, SM, SC, as a lubricant, the external additive for the toner is principally supplied periodically (intermittently) to between the photosensitive drums 1 and the cleaning blades 61. In this embodiment, as a value relating to the used amount of the photosensitive drum 1, a travelling distance of the photosensitive drum 1 is used. In this embodiment, the controller 150 detects the traveling distance of the photosensitive drum 1 and has a function (drum traveling distance counter) of storing the traveling distance in the memory 11.

In the contacting operation, when the developing roller 41 is contacted to the photosensitive drum 1, the developing roller 41 is rotationally driven. Further, in the contacting operation, when the developing roller 41 is contacted to the photosensitive drum 1, the photosensitive drum 1 is charged (to about −600 V in surface potential), and the developing voltage (about −350 V) is applied to the developing roller 41. However, at the YMC image forming portions SY, SM, SC, formation of the image portion of the latent image (i.e., exposure of the image portion to light in this embodiment) by the exposure device 3 is not performed. That is, the developing roller 41 is contacted to a portion of the photosensitive drum 1 where the surface potential is maintained at about −600 V. The developing voltage is a voltage for urging the developer from the developing member toward the image portion of the latent image on the image bearing member and is about −350 V, and this voltage value is smaller in absolute value than the surface potential of the photosensitive drum 1. Accordingly, at this time, at the YMC image forming portions SY, SM, SC, the toner itself does not readily move from the developing roller 41 toward the photosensitive drum 1, but the external additive for the toner sides on the photosensitive drum 1 and is scraped off from the toner and thus is in a state in which the external additive can move onto the photosensitive drum 1. Accordingly, principally the external additive moved to the photosensitive drum 1 functions as the lubricant to lower a degree of friction between the cleaning blade 61 and the photosensitive drum 1, so that generation noise (cleaning noise) can be suppressed. As described above, the developing roller 41 to which the voltage (the developing voltage smaller in absolute value than the surface potential of the photosensitive drum 1) for urging the developer from the developing member toward the image portion of the latent image on the image bearing member is contacted to the photosensitive drum 1 while charging the photosensitive drum 1. As a result, principally the external additive for the toner can be moved onto the photosensitive drum 1 while suppressing the movement of the toner itself to the photosensitive drum 1. Accordingly, it is possible to suppress consumption of the toner while supplying the external additive as the lubricant. Description will be made specifically.

Figure 3:
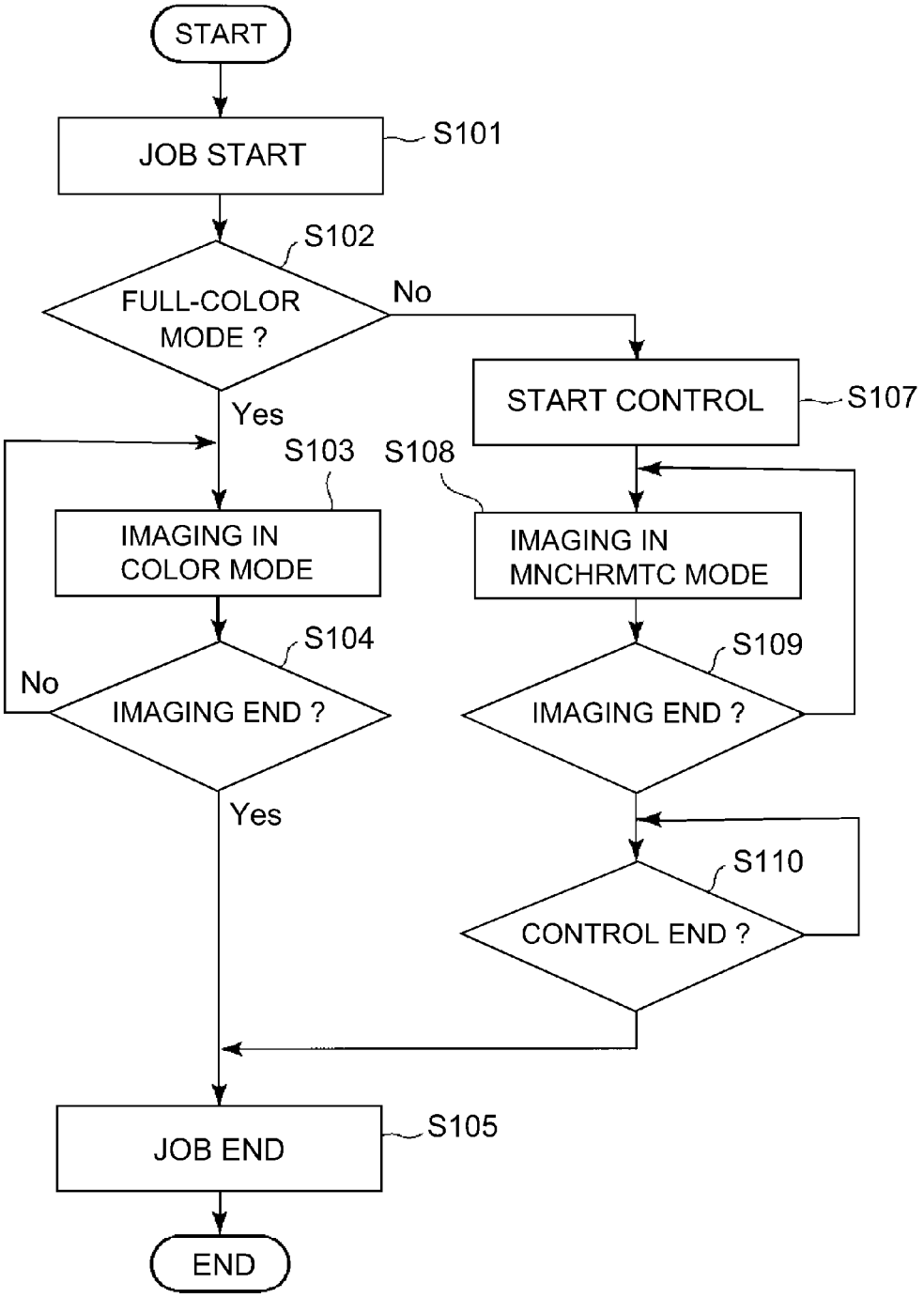
FIG. 3 is a flowchart in Embodiment 1.
Figure 4:
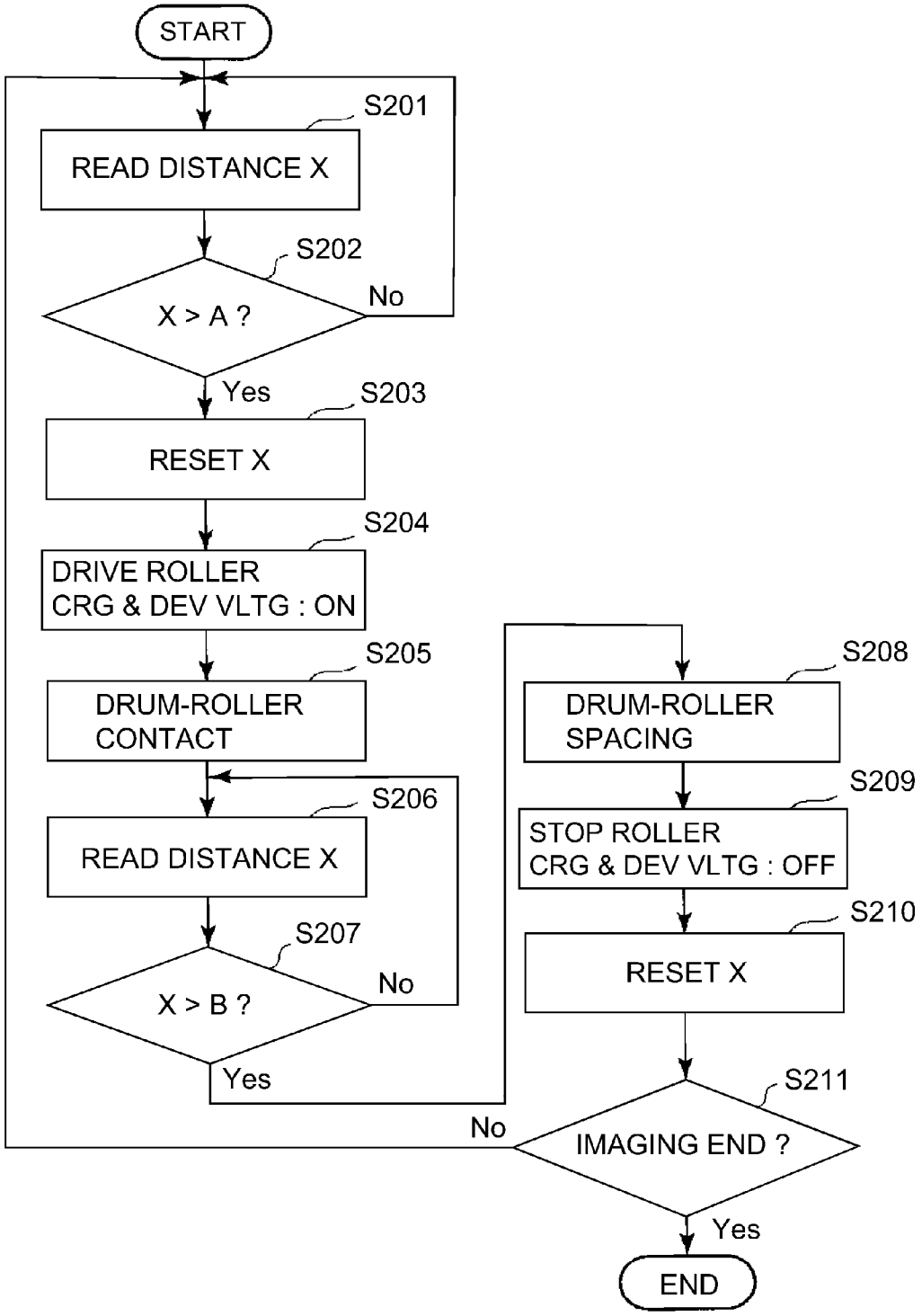
FIG. 4 is a flowchart in Embodiment 1.

FIG. 3 is a schematic flowchart of a job executed by the image forming apparatus 100 in this embodiment, and FIG. 4 is a flowchart of control for executing the contacting operation (herein also referred to as "lubricant supply control"). The job is a series of operations, which are started in accordance with a single image formation instruction, for forming and outputting the image on a single or a plurality of recording materials P.

Referring to FIG. 3, when a job start instruction is inputted (S101), the controller discriminates whether the job is a job for the full-color mode or a job for the monochromatic mode (S102). In S102, in the case where the controller 150 discriminates that the job is the job for the full-color mode, the controller 150 causes the YMCK image forming portions SY, SM, SC, SK to effect image formation as described above (S103). Then, when the image formation of a number of sheets designated in the job is ended (S104), the controller 150 ends the job (S105). On the other hand, in S102, in the case where the controller 150 discriminates that the job is the job for the monochromatic mode, the controller 150 starts the lubricant supply control in accordance with the flowchart of FIG. 4 (S107) and also causes only the K image forming portion SK to effect the image formation (S108). At this time, at the YMC image forming portions SY, SM, SC, the developing rollers 41 are spaced from the photosensitive drums 1 and the rotational drive of the developing rollers 41 is stopped, and the charging voltage and the developing voltage are not applied. Then, when the image formation of a number of sheets designated in the job is ended (S109), the controller 150 waits for end of the lubricant supply control (5110), and ends the job (S105).

Referring to FIG. 4, when the controller 150 starts the lubricant supply control, the controller reads traveling distances X (Xy, Xm, Xc) of the YMC photosensitive drums 1Y, 1M, 1C during the operation in the monochromatic mode from the YMC memories 11Y, 11M, 11C, respectively (S201). When the operation in the monochromatic mode is started, the traveling distances X (Xy, Xm, Xc) are successively integrated and stored in the YMC memories 11Y, 11M, 11C, respectively. In the case where the values of X (Xy, Xm, Xc) exceed a first threshold A (corresponding to 80 images having a predetermined size) (S202), the values of X (Xy, Xm, Xc) are reset to 0 (S203). Then, the controller 150 not only starts the rotational drive of the developing rollers 41 but also turns on the charging voltage and the developing voltage at the YMC image forming portions SY, SM, SC (S204). At this time, when the charging voltage is turned on the charging voltage is about −1100 V, so that the surface potential of the YMC photosensitive drums 1Y, 1M, 10 is about −600 V. Further, when the developing voltage is turned on, the developing voltage is about −350 V. Thereafter, the controller 150 contacts the developing rollers 41 with the photosensitive drums 1 of the YMC image forming portions SY, SM, SC (S205). At this time, principally the external additive for the toner moves onto the YMC photosensitive drums 1. Substantially, the controller 150 reads the traveling distances X (Xy, Xm, Xc) from the YMC memories 11Y, 11M, 11C, respectively (S206). In the case where the values X (Xy, Xm, Xc) exceed a second threshold B (corresponding to two images having a predetermined size) (S207), the controller 150 causes the developing rollers 41 to be spaced from the photosensitive drums 1 of the YMC image forming portions SY, SM, SC (S208). Thereafter, the controller 150 not only stops the rotational drive of the developing rollers 41 at the YMC image forming portions SY, SM, SC but also turns off the charging voltage and the developing voltage (S209). Then, the controller 150 resets the values of X (Xy, Xm, Xc) to 0 (S210), and repeats the process of S201-S211 until the image formation of the number of sheets designated in the job (S211).

Incidentally, the contacting operation executed at the YMC image forming portions SY, SM, SC during the operation in the monochromatic mode can be executed in parallel to the image formation at the K image forming portion SK. That is, the contacting operation can be executed in a period at least partly overlapping with a period in which either one of the latent image formation, the development and the primary transfer at the K image forming portion SK. However, the present invention is not limited thereto, but the contacting operation may also be executed by temporarily interrupting the image formation at the K image forming portion SK.

5. Effect

Figure 5:
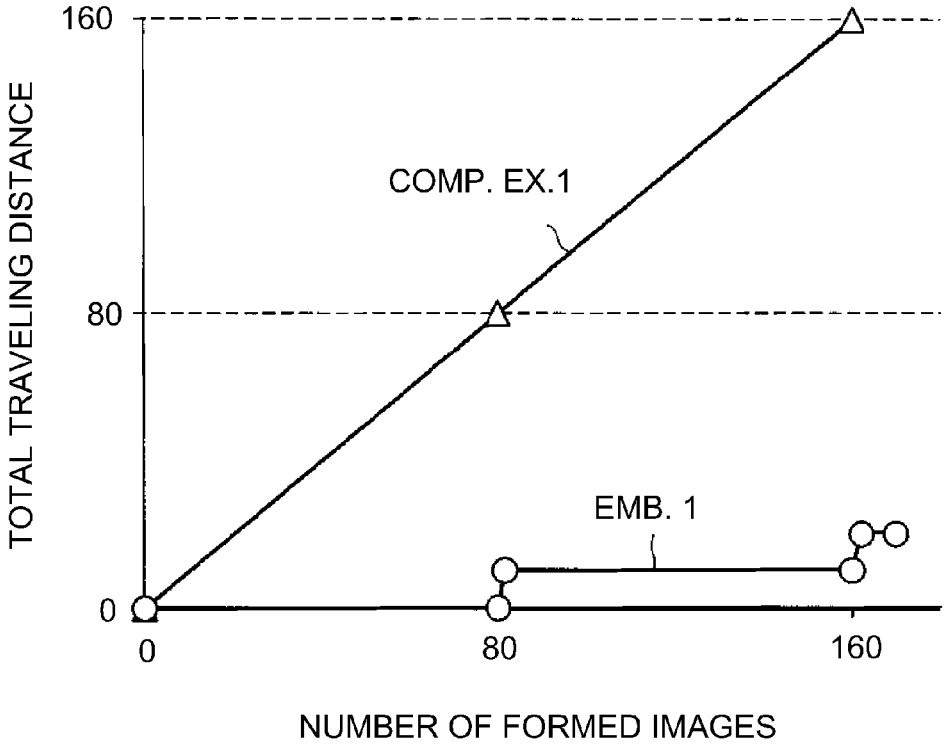
FIG. 5 is a graph for illustrating an effect of Embodiment 1.

An effect of this embodiment will be described. FIG. 5 is a graph showing a relationship between a number of formed images in the operation in the monochromatic mode and a total traveling distance of the YMC developing rollers 41Y, 41M, 41C during the operation in the monochromatic mode.

The abscissa is the number of formed images, and the ordinate is the total traveling distance of the YMC developing rollers 41Y, 41M, 41C.

First, in the case where the developing rollers 41 are contacted to the photosensitive drums 1 at the YMC image forming portions SY, SM, SC simultaneously with start of the job of the operation in the monochromatic mode (Comparison Example 1), the total traveling distance of the YMC developing rollers 41Y, 41M, 41C simply increase. For that reason, although the images are not formed at the YMC image forming portions SY, SM, SC in the operation in the monochromatic mode, toner deterioration progresses due to the drive of the developing rollers 41. When the toner deterioration progresses, an amount of a fog toner formed at a white background portion through the development increases, so that a toner consumption amount increases. Also progression of the contact time between the photosensitive drums 1 and the developing rollers 41 at the YMC image forming portions SY, SM, SC during the operation in the monochromatic mode in Comparison Example 1 is similar to a result of Comparison Example 1 in FIG. 5. For that reason, at the YMC image forming portions SY, SM, SC, although the images are not formed in the operation in the monochromatic mode, deterioration due to abrasion between the photosensitive drums 1 and the developing rollers 41 progresses.

On the other hand, in this embodiment, during the operation in the monochromatic mode, the developing rollers 41 were contacted to the photosensitive drums 1 every time when a traveling distance X exceeded a distance corresponding to the 80 images on an image number basis. Then, every time when the traveling distance X exceeded a distance corresponding to the two images on the image number basis after the contact, the developing rollers 41 were spaced from the photosensitive drums 1. For that reason, in this embodiment, the total traveling distance of the YMC developing rollers 41Y, 41M, 41C can be remarkably shortened compared with Comparison Example 1. For that reason, the toner deterioration at the YMC image forming portions SY, SM, SC can be suppressed. By suppressing the toner deterioration, the amount of the fog toner formed at the white background portion through the development as described above can also be reduced, so that the toner consumption amount can be decreased. Also progression of the contact time between the photosensitive drums 1 and the developing rollers 41 at the YMC image forming portions SY, SM, SC during the operation in the monochromatic mode in this embodiment is similar to a result of this embodiment in FIG. 5. Accordingly, a contact opportunity between the photosensitive drums 1 and the developing rollers 41 at the YMC image forming portions SY, SM, SC in the operation in the monochromatic mode is reduced, so that the deterioration due to abrasion between the photosensitive drums 1 and the developing rollers 41 can be suppressed.

Further, during the operation in the monochromatic mode, a similar experiment was conducted while spacing the developing rollers 41 from the photosensitive drums 1 without contacting the developing rollers with the photosensitive drums 1 at the YMC image forming portions SY, SM, SC (Comparison Example 2). As a result, noise (cleaning blade noise) due to the cleaning blades 61Y, 61M, 61C of the YMC image forming portions SY, SM, SC generated in some cases. On the other hand, in this embodiment, it was confirmed that in the operation in the monochromatic mode, at the YMC image forming portions SY, SM, SC, the cleaning blade noise does not generate or can be suppressed at a level of a practically no problem since a degree of generation is remarkably small compared with Comparison Example 2 even when the cleaning blade noise generates.

As described above, according to this embodiment, at the YMC image forming portions SY, SM, SC, it is possible to suppress not only the deterioration of the photosensitive drums 1, the developing rollers 41 and the toners but also the generation of the noise due to the cleaning blades 61.

Embodiment 2

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

In this embodiment, a plurality of each of the first threshold A and the second threshold B which are described in Embodiment 1 are set depending on information on a used amount of the YMC developing devices 4Y, 4M, 4C. Then, when the contacting operation is executed during the operation in the monochromatic mode, the controller 150 selects the first threshold A and the second threshold B used for control depending on the information on the used amount of the YMC developing devices 4Y, 4M, 4C at that time. In this embodiment, as a value relating to the used amount of the developing device 4, a lifetime value of the developing device 4 is used.

Here, the lifetime value of the developing device 4 will be described. In this embodiment, the lifetime of the developing device 4 is set using, as an index, a deterioration state of the developing device 4 (the toner, the developing roller 41, the developing blade 42 or the like) estimated from the traveling distance of the developing roller 41. When the developing device 4 (process cartridge 10) is new, i.e., at the time when the traveling distance of the developing roller 41 is zero, the lifetime value is 100%. Further, at the time when the traveling distance of the developing roller 41 reaches a predetermined value, the lifetime value is 0%. The predetermined value is set in advance depending on the traveling distance of the developing roller 41 corresponding to a state in which the toner, the developing roller 41 or the developing blade 42 is deteriorated to the extent requiring exchange (replacement) of the developing device 4 (process cartridge 10) in order to suppress various image defects. In this embodiment, the controller 150 has the function (lifetime counter) of detecting the traveling distance of the developing roller 41, obtaining the lifetime value of the developing device 4 and storing the lifetime value in the memory 11.

Table 1 shows set values of the first threshold A and the second threshold B depending on the lifetime values of the YMC developing devices 4Y, 4M, 4C in this embodiment.

TABLE 1

| | Lifetime Value (%) | | | | |
|---|---|---|---|---|---|
| | 0-19 | 20-39 | 40-59 | 60-79 | 80-100 |
| TH A*1 | 40 | 45 | 55 | 60 | 80 |
| TH B*2 | 12 | 10 | 7 | 4 | 2 |

*1"TH A" is the threshold A which is on the image number basis.
*2"TH B" is the threshold B which is on the image number basis.

As shown in Table 1, with a decreasing lifetime value of the YMC developing devices 4Y, 4M, 4C, the first threshold A is set so as to decrease and the second threshold B is set so as to increase. This is because not only the lifetime value of the developing device 4 decreases but also the toner deterioration progresses and a lubricating property of the toner is impaired and thus the cleaning blade noise is liable to generate in the latter half of the lifetime of the developing device 4 in some cases. By using the first threshold A and the second threshold B selected in accordance with Table 1, with the decreasing lifetime value of the YMC developing devices 4Y, 4M, 4C, an execution interval of the contacting operation becomes short when the operation in the monochromatic mode is continuously executed. That is, the contact position is performed more frequently. Further, with the decreasing lifetime value of the YMC developing devices 4Y, 4M, 4C, a period from the contact of the developing rollers 41 with the photosensitive drums 1 in the contacting operation to the spacing of the developing rollers 41 from the photosensitive drums 1 becomes long. That is, a lubricant supplying state is maintained for a longer period.

In this way, in this embodiment, the execution interval of the contacting operation when the operation in the monochromatic mode is continuously executed is changed depending on the information on the used amount of the developing device 4 of the image forming portion where the image is not formed in the operation in the monochromatic mode. Particularly, in this embodiment, the above interval is changed so as to be smaller in the case where the used amount shown by the information is a second value larger than a first value than in the case where the used amount shown by the information is the first value. In this embodiment, the controller 150 changes the predetermined period in which the developing roller 41 is maintained in the contact state in the contacting operation, depending on the information on the used amount of the developing device 4 of the image forming portion where the image is not formed in the operation in the monochromatic mode. Particularly, in this embodiment, the predetermined period is changed so as to be longer in the case where the used amount shown by the information is the second value larger than the first value than in the case where the used amount shown by the information is the first value.

Figure 6:
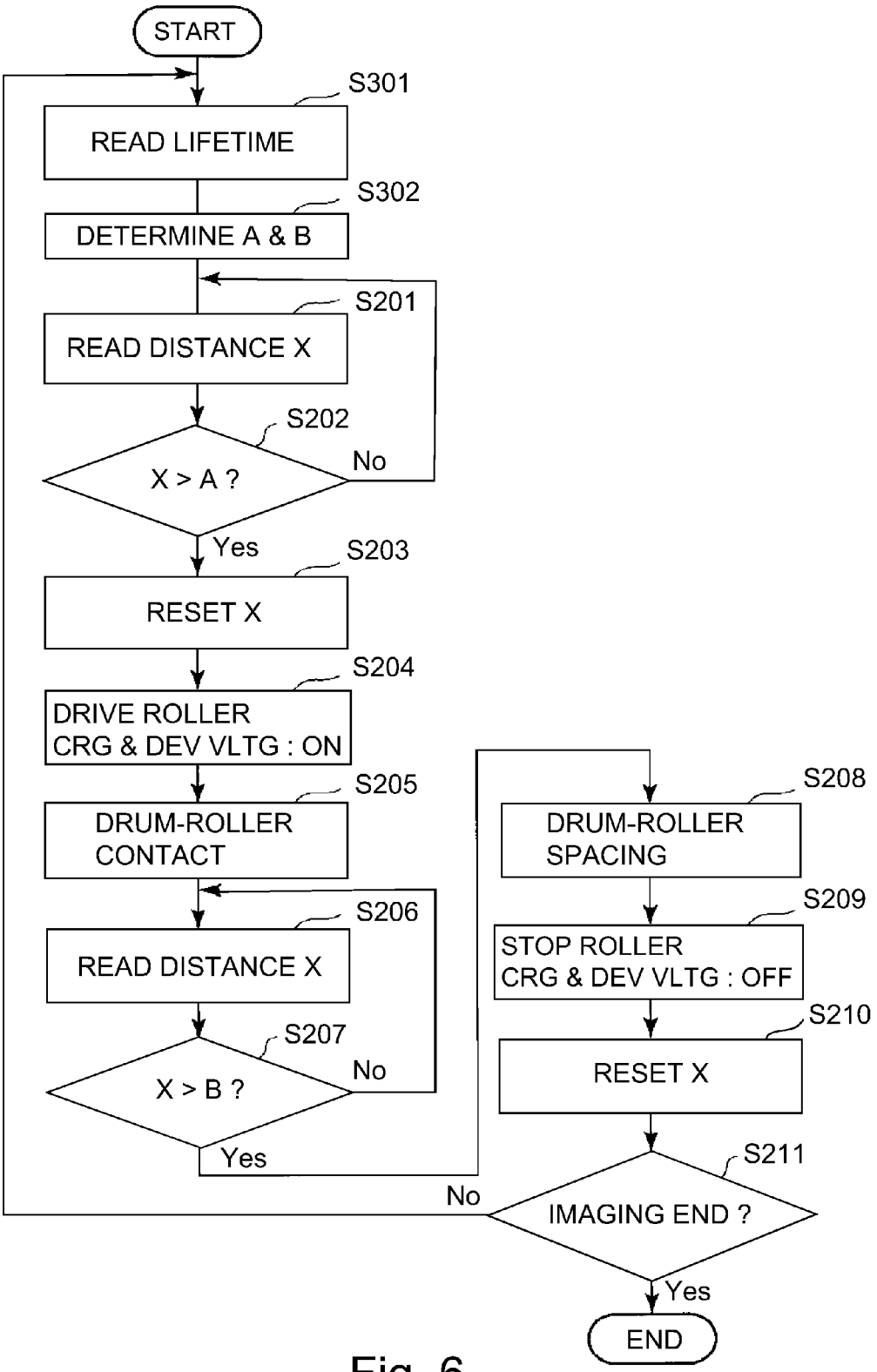
FIG. 6 is a flowchart in Embodiment 2.

FIG. 6 is a flowchart of lubricant supplying control in this embodiment. In FIG. 6, the steps identical to those shown in FIG. 4 in Embodiment 1 are represented by the same step numbers or symbols. As shown in FIG. 6, in this embodiment, when the lubricant supply control is started, the controller 150 reads the lifetime values of the YMC developing devices 4Y, 4M, 4C (S301), and determines the first thresholds A and the second thresholds B used for the control (S302). Set values for the first thresholds A and the second thresholds B in accordance with Table 1 are stored in advance in the controller 150. In this embodiment, when the job is started, the lifetime values of all of the developing devices 4 are successively integrated and stored in the YMC memories 11Y, 11M, 11C. The control in the subsequent steps is the same as in Embodiment 1.

As described above, according to this embodiment, it is possible to not only obtain an effect similar to the effect of Embodiment 1 but also satisfactorily suppress the cleaning blade noise even in the latter half of the lifetime of the developing device when the lubricating property of the toner is impaired.

Embodiment 3

Another embodiment of the present invention will be described. Basic constitution and operation of an image forming apparatus in this embodiment are the same as those in Embodiments 1 and 2. Accordingly, elements having the same or corresponding functions or constitutions as those for the image forming apparatus in Embodiments 1 and 2 are represented by the same reference numerals or symbols, and will be omitted from detailed description.

In this embodiment, each of the first threshold A and the second threshold B used in Embodiment 2 is corrected depending on an operation (use) environment condition of the image forming apparatus 100. In this embodiment, as the operation environment condition of the image forming apparatus 100, an absolute water content in the environment of the image forming apparatus 100 is used. For that reason, the image forming apparatus 100 is provided, as an environment detecting means, with a temperature and humidity sensor 12 (FIG. 1). Every input of a job for an operation in the monochromatic mode, the controller 150 reads a value of the absolute water content detected by the temperature and humidity sensor 12. Then, depending on the read value of the absolute water content and the lifetime value of the developing device 4, the controller 150 determines the first threshold A and the second threshold B which are used in the lubricant supply control.

Table 2 shows set values of the first threshold A and the second threshold B depending on the absolute water contents in the environment and the lifetime values of the YMC developing devices 4Y, 4M, 4C in this embodiment.

TABLE 2

| | Lifetime Value (%) | | | | |
|---|---|---|---|---|---|
| | 0-19 | 20-39 | 40-59 | 60-79 | 80-100 |
| AWC*1 ($g/m^3$) ≥ 24.3 | | | | | |
| TH A*2 | 50 | 60 | 75 | 85 | 100 |
| TH B*3 | 8 | 7 | 5 | 3 | 1 |
| 24.3 > AWC*1 ($g/m^3$) > 1.3 | | | | | |
| TH A*2 | 40 | 45 | 55 | 60 | 800 |
| TH B*3 | 12 | 10 | 7 | 4 | 2 |
| 1.3 ≥ AWC*1 ($g/m^3$) | | | | | |
| TH A*2 | 20 | 30 | 40 | 50 | 60 |
| TH B*3 | 16 | 12 | 8 | 5 | 3 |

*1"AWC" is an absolute water content.
*2"TH A" is the threshold A which is on the image number basis.
*3"TH B" is the threshold B which is on the image number basis.

As shown in Table 2, in the case where the lifetime value of the developing device 4 is the same, with a decreasing absolute water content, the first threshold A is set so as to decrease and the second threshold B is set so as to increase. This is because in an environment in which the absolute water content is low, a hardness of the cleaning blade 61 increases and therefore a scraping property for the external additive for the toner supplied on the photosensitive drum 1 becomes strong and thus the cleaning blade noise is liable to generate in the latter half of the lifetime of the developing device 4 in some cases. By using the first threshold A and the second threshold B selected in accordance with Table 1, in the case where the lifetime value of the YMC developing devices 4Y, 4M, 4C is the same, with the decreasing absolute water content an execution interval of the contacting operation becomes short when the operation in the monochromatic mode is continuously executed. That is, the contact position is performed more frequently. Further, in the case where the lifetime value of the YMC developing devices 4Y, 4M, 4C is the same, with the decreasing absolute water content, a period from the contact of the developing rollers 41 with the photosensitive drums 1 in the contacting operation to the spacing of the developing rollers 41 from the photosensitive drums 1 becomes long. That is, a lubricant supplying state is maintained for a longer period.

In this way, in this embodiment, the execution interval of the contacting operation when the operation in the monochromatic mode is continuously executed is changed depending on the information on the environment of the image forming apparatus 100. Particularly, in this embodiment, the above interval is changed so as to be smaller in the case where the value of the information is a fourth value larger than a third value than in the case where the absolute water content of the image forming apparatus 100 in the environment is the third value. In this embodiment, the controller 150 changes the predetermined period in which the developing roller 41 is maintained in the contact state in the contacting operation, depending on the information on the environment of the image forming apparatus 100. Particularly, in this embodiment, the predetermined period is changed so as to be longer in the case where the absolute water content of the image forming apparatus 100 in the environment is the fourth value larger than the third value than in the case where the value of the information is the third value.

The lubricant supply control in this embodiment is effected similarly as in the flowchart of FIG. 6 described in Embodiment 2. However, in this embodiment, a difference from Embodiment 2 is that the controller 150 reads also a detection result of the temperature and humidity sensor 12 in S301 and determines the first threshold A and the second threshold B on the basis of the absolute water content and the lifetime value of the developing device 4 in S302.

As described above, according to this embodiment, it is possible to not only obtain effects similar to those in Embodiments 1 and 2 but also satisfactorily suppress the cleaning blade noise even in the environment in which the absolute water content is low.

In this embodiment, the first threshold A and the second threshold B were determined on the basis of the absolute water content in the environment and the lifetime value of the developing device 4, but may also be determined depending on only the absolute water content in the environment.

Other Embodiments

The present invention was described above based on the specific embodiments, but is not limited to the above-described embodiments.

For example, in the above-described embodiments, the case where the image forming apparatus is operable in the full-color mode and the monochromatic mode was described, but the present invention is not limited thereto. Effects similar to those described above can be obtained by applying the present invention to the case where the image forming apparatus is capable of executing an operation in a mode in which the image is formed only at a part of the plurality of image forming portions and the image bearing member is rotated also at the image forming portion where the image is not formed in the operation in the mode.

In the above-described embodiments, the developing members of the image forming portions are driven by independent motors, but for example, the drive (driving force) may also be inputted from a common motor for driving the plurality of image bearing members to all of the image bearing members and all of the developing members. In this case, by the operation of spacing the developing members from the image bearing members, the input of the drive from the common motor to the developing members can be eliminated in interrelation with the operation.

In the above-described embodiments, as shown in FIG. 3, the job for the operation in the monochromatic mode is ended after waiting for the end of the lubricant supply control, but the job may also be ended in the following manner. For example, at the time when the image formation of the number of sheets designated in the job is ended, even before the value of X after the contact of the developing rollers with the photosensitive drums at the YMC image forming portions exceeds the second threshold B, the lubricant supply control is ended and then the job may also be ended. In this case, when the lubricant supply control is ended, without resetting X to 0, X may also be decreased correspondingly to a period in which the developing roller is finally contacted to the photosensitive drum at the YMC image forming portions.

The values of the thresholds are not limited to those shown in the above-described embodiments, but can also be appropriately set so that the generation of the cleaning blade noise can be suppressed.

The information on the used amount of the photosensitive drum is not limited to the traveling distance obtained on the image number basis used in the above-described embodiments, but may also be the number of times of rotation, a rotation time or the like. Also the information on the used amount of the developing device is not limited to the lifetime value of the developing device used in the above-described embodiments, but may also be the number of times of rotation of the developing roller, a rotation time, a value converted into the image number or the like.

Figure 7:
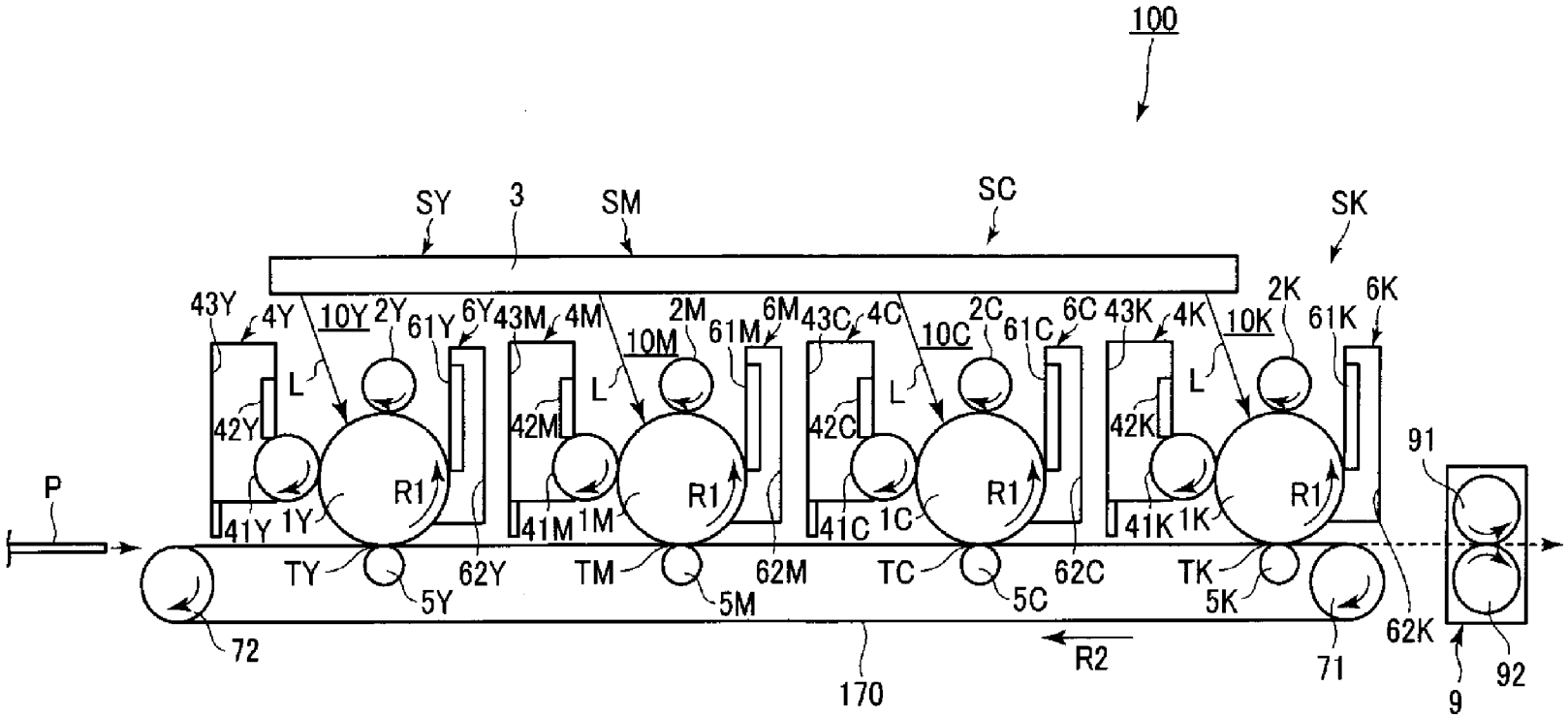
FIG. 7 is a schematic sectional view of a principal part of an image forming apparatus in another embodiment.

In the above-described embodiments, the image forming apparatus of the intermediate transfer type was described as an example, but the present invention is also applicable to an image forming apparatus of a direct transfer type. FIG. 7 is a schematic sectional view of a principal part of the image forming apparatus of the direct transfer type. In FIG. 7, elements having the same or corresponding functions or constitutions are represented by the same reference numerals or symbols. The image forming apparatus 100 in FIG. 7 includes, in place of the intermediary transfer belt 7, a recording material carrying belt 170 constituted by an endless belt as a recording material carrying member. In the image forming apparatus 100 in FIG. 7, each of toner images formed on the photosensitive drums 1 at the image forming portions S is transferred onto the recording material P carried and fed on the recording material carrying belt 170. Also in such an image forming apparatus 100 of the direct transfer type, similarly as in the case of the image forming apparatus of the intermediary transfer type in the above-described embodiments, a degree of the cleaning blade noise may desirably be reduced at the image forming portion where the image is not formed. Accordingly, the present invention is also applicable to the image forming apparatus of the direct transfer type, and effects similar to those in the above-described embodiments can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-024792 filed on Feb. 10, 2015 and 2016-005569 filed on Jan. 14, 2016, which are hereby incorporated by reference herein in their entirety.

What is claimed is:

1. An image forming apparatus comprising:

a plurality of image forming portions each including an image bearing member to be rotationally driven, charging means for electrically charging the image bearing member, exposure means for exposing the charged image bearing member to light to form a latent image including an exposed portion as an image portion, developing means, including a developing member movable toward and away from the image bearing member, for forming an image with a developer on the image bearing member by contacting the developing member with the image bearing member, and a cleaning member for removing the developer from the image bearing member in contact with the image bearing member;

contact-and-separation means for moving the developing member toward and away from an associated one of the image bearing members of said image forming portions;

a voltage source for applying, to the developing member, a developing voltage for urging the developer toward the image portion of the latent image on the image bearing member, wherein said image forming apparatus is capable of executing an operation in a mode in which the image is formed only at a part of said image forming portions, and the operation in the mode is executed in a state in which the developing member is contacted to the image bearing member at said part of said image forming portions where the image is formed and the developing member is separated from the image bearing member at another part of said image forming portions where the image is not formed and in which the image bearing members of said part of said image forming portions where the image is formed and said another part of said image forming portions where the image is not formed are driven; and control means for executing a contacting operation for contacting the developing member to which the developing voltage is applied with the image bearing member, charged by the charging means, for a predetermined period, wherein in the contacting operation, said exposure means does not form the latent image on the image bearing member, and wherein when the operation in the mode is continuously executed, said control means executes the contacting operation at said another part of said image forming portions where the image is not formed.

2. The image forming apparatus according to claim 1, wherein said control means changes an execution interval of the contacting operation when the operation in the mode is continuously executed, on the basis of information on a used amount of the developing means at said another part of said image forming portions where the image is not formed.

3. The image forming apparatus according to claim 2, wherein when the used amount shows a first value and a second value larger than the first value, said control means makes the execution interval smaller at the second value than at the first value.

4. The image forming apparatus according to claim 1, wherein said control means changes the predetermined period in the operation in the mode on the basis of information on a used amount of the developing means at said image forming apparatus where the image is not formed.

5. The image forming apparatus according to claim 4, wherein when the used amount shows a first value and a second value larger than the first value, said control means makes the predetermined period longer at the second value than at the first value.

6. The image forming apparatus according to claim 1, wherein said control means changes an execution interval of the contacting operation when the operation in the mode is continuously executed, on the basis of information on an environment of said image forming apparatus.

7. The image forming apparatus according to claim 6, wherein when the information on the environment is an absolute water content showing a first value and a second value smaller than the first value, said control means makes the execution interval smaller at the second value than at the first value.

8. The image forming apparatus according to claim 1, wherein said control means changes the predetermined period on the basis of information on an environment of said image forming apparatus.

9. The image forming apparatus according to claim 8, wherein when the information on the environment is an absolute water content showing a first value and a second value smaller than the first value, said control means makes the execution interval smaller at the second value than at the first value.

10. The image forming apparatus according to claim 1, wherein the image bearing members of said image forming portions are driven by a common driving source.

11. The image forming apparatus according to claim 1, wherein each of the developing members of said image forming portions is rotationally driven when contacted to an associated image bearing member, and rotational drive thereof is stopped when said developing member is spaced from the associated image bearing member.

12. An image forming apparatus comprising:

a plurality of image forming portions each including an image bearing member to be rotationally driven, developing means, including a developing member movable toward and away from the image bearing member, for forming an image with a developer on the image bearing member by contacting the developing member with the image bearing member, and a cleaning member for removing the developer from the image bearing member in contact with the image bearing member;

contact-and-separation means for moving the developing member toward and away from an associated one of the image bearing members of said image forming portions, wherein said image forming apparatus is capable of executing an operation in a mode in which the image is formed only at a part of the image forming portions, the operation in the mode being executed in a state in which the developing member is contacted to the image bearing member at said part of said image forming portions where the image is formed and the developing member is separated from the image bearing member at another part of said image forming portions where the image is not formed and in which the image bearing members of said part of said image forming portions where the image is formed and said another part of said image forming portions where the image is not formed are driven; and control means for executing a contacting operation for contacting the developing member with the image bearing member for a predetermined period at said another part of said image forming portions where the image is not formed when the operation in the mode is continuously executed, wherein said control means changes the predetermined period in the contacting operation on the basis of information on an environment of said image forming apparatus.

13. The image forming apparatus according to claim 12, wherein when the information on the environment is an absolute water content showing a first value and a second value smaller than the first value, said control means makes the execution interval smaller at the second value than at the first value.

14. The image forming apparatus according to claim 12, wherein the image bearing members of said image forming portions are driven by a common driving source.

15. An image forming apparatus comprising:

a plurality of image forming portions each including an image bearing member to be rotationally driven, charging means for electrically charging the image bearing member, exposure means for exposing the charged image bearing member to light to form a latent image including an exposed portion as an image portion, developing means, including a developing member movable toward and away from the image bearing member, for forming an image with a developer on the image bearing member by contacting the developing member with the image bearing member, and a cleaning member for removing the developer from the image bearing member in contact with the image bearing member;

contact-and-separation means for moving the developing member toward and away from an associated one of the image bearing members of said image forming portions;

a voltage source for applying a voltage to the developing member, wherein said image forming apparatus is capable of executing an operation in a mode in which the image is formed only at a part of the image forming portions, the operation in the mode being executed in a state in which the developing member is contacted to the image bearing member at said part of said image forming portions where the image is formed and the developing member is separated from the image bearing member at another part of said image forming portions where the image is not formed and in which the image bearing members of said part of said image forming portions where the image is formed and said another part of said image forming portions where the image is not formed are driven and control means for executing a contacting operation for contacting the developing member to which a voltage smaller in absolute value than a surface potential of the charged image bearing member is applied with the image bearing member charged by the charging means for a predetermined period at said another part of said image forming portions where the image is not formed when the operation in the mode is continuously executed, wherein in the contacting operation, said exposure means does not form the latent image on the image bearing member.

16. The image forming apparatus according to claim 15, wherein said control means changes an execution interval of the contacting operation when the operation in the mode is continuously executed, on the basis of information on a used amount of the developing means at said another part of said image forming portions where the image is not formed.

17. The image forming apparatus according to claim 15, wherein said control means changes the predetermined period in the operation in the mode on the basis of information on a used amount of the developing means at said image forming apparatus where the image is not formed.

18. The image forming apparatus according to claim 15, wherein said control means changes an execution interval of the contacting operation when the operation in the mode is continuously executed, on the basis of information on an environment of said image forming apparatus.

19. The image forming apparatus according to claim 15, wherein the image bearing members of said image forming portions are driven by a common driving source.

* * * * *